United States Patent [19]

Domaracki et al.

[11] 3,974,928

[45] Aug. 17, 1976

[54] CHILD RESISTANT SAFETY CLOSURE AND CONTAINER ASSEMBLY

[75] Inventors: John F. Domaracki; Leonard M. McBride; Frank Wack, all of Windsor, Canada

[73] Assignee: International Tools (1973) Ltd., Windsor, Canada

[22] Filed: May 7, 1975

[21] Appl. No.: 575,298

[52] U.S. Cl. ..... 215/211; 215/222; 215/350

[51] Int. Cl.[2] ..... B65D 55/02; B65D 85/56; A61J 1/00

[58] Field of Search ..... 215/211, 9, 222, 342, 215/350

[56] References Cited

UNITED STATES PATENTS

| | | | |
|---|---|---|---|
| 3,623,623 | 11/1971 | Bauer | 215/222 X |
| 3,756,445 | 9/1973 | Hedgewick | 215/211 X |
| 3,896,959 | 7/1975 | Roy | 215/222 |

*Primary Examiner*—George T. Hall
*Attorney, Agent, or Firm*—Reising, Ethington, Barnard, Perry & Brooks

[57] ABSTRACT

An improved child resistant safety closure and container assembly of the type including a cap having an end wall with a skirt projecting therefrom and bayonet locking means projecting from the inner wall of the skirt for engagement with complementary bayonet locking means on the container by combined axial and rotary motion of the cap relative to the container. A combined spring and sealing member is carried by the cap, which, when the cap is applied to the container, resiliently maintains the cap and container in locked engagement, and also provides a moisture proof seal for the contents of the container. The spring and sealing member comprises a one-piece plastic body having a sealing portion and a biasing portion, the sealing portion including a radially projecting, annular sealing flange for overlying the rim of the container, and an axially extending sealing flange for engaging the inner surface of the mouth of the container. The radially extending sealing flange has an outer peripheral edge that overlies the bayonet locking means of the cap to prevent axial separation of the spring and sealing member from the cap, the spring and sealing member being otherwise unconnected with the cap. The spring and sealing member includes a dome-like biasing portion that projects integrally from the inner periphery of the radially projecting sealing flange which, when the cap is applied to the container, flexes and bows outwardly in a manner to apply a force on the sealing portion having a substantial axial component to press the sealing portion into tight engagement with the rim of the container, and also the radial component to press the axially extending sealing flange into tight engagement with the inner surface of the mouth of the container.

2 Claims, 2 Drawing Figures

CHILD RESISTANT SAFETY CLOSURE AND CONTAINER ASSEMBLY

BACKGROUND OF THE INVENTION

1. Field of the Invention

This invention relates generally to safety closure and container assemblies, and is particularly concerned with an improvement in safety closure and container assemblies wherein it is necessary to provide a liquid or moisture-proof seal for the contents of the container.

2. Description of the Prior Art

In order to reduce the number of accidental poisonings resulting from young children having access to unsafe medicines, drugs, household chemicals and other products, there has been considerable activity in recent years towards the development of closures and containers in which a type of manipulation between the cap and container is required in order to gain access to the contents of a container that a young child is incapable of performing. For example, it has been found that young children are generally incapable of manipulating a cap mounted on a container with bayonet-type locking means, that is, a type of locking means that requires that the cap be pushed axially relative to the container and then rotated relative to the container in order to separate the cap from the container. The cap must be pushed axially toward the container against the biasing force of a spring in order to disengage the bayonet locking means. See, for example, Hedgewick U.S. Pat. No. Re. 27,156.

When the contents of the container is liquid, or is some substance that deteriorates in an atmosphere of high humidity, the closure must be capable of maintaining an adequate seal under a variety of conditions. The contents of the container, if liquid, may require vigorous shaking before being used, or the contents may be of the type that causes a pressure buildup within the container over a period of time. A tight seal is also necessary in order to prevent the undesired escape of the contents from the container, and because the entrance of moisture into the container may cause deterioration of the contents.

In order to maintain a good seal against the entrance or escape of moisture, it is desirable to be able to provide a seal that projects into the mouth of the container and engages the inner surface of the container mouth with a tight fit. While the spring force on the cap should be sufficient to prevent children from gaining access to the contents, it should not be so great as to make it unduly difficult for adults to manipulate the cap. Accordingly, a tight seal must be maintained by the closure without at the same time making it too difficult for adults to manipulate the closure. Since the closure must be applied to and removed from the container many times, the spring member must be capable of many cycles of deflection and relaxation without rupture. Furthermore, the construction of the closure and spring member must be such that the seal is firmly pressed against the container rim and the inner surface of the mouth of the container when the closure is placed on the cap and locked in position.

Hedgewick et al U.S. Pat. Nos. 3,478,911 and 3,485,403 illustrate safety cap and container assemblies wherein a flat disk overlies the container rim and is held captive in the cap by the bayonet lugs of the cap. In the construction illustrated in the latter Hedgewick et al patents, the flat disk is pressed against the container rim by elements formed integrally with and projecting from the end wall of the caps of the closure assemblies.

In Nichols U.S. Pat. No. 3,072,276, a closure assembly is illustrated in which a cap having bayonet lugs includes a plastic disk member which is dished at its center with the thickened periphery of the disk member overlying the bayonet locking lugs of the cap. An axially depending flange is received in the mouth of the container. A post projects integrally upwardly from the disk to engage the end wall of the cap and to cause the disk to deflect when the cap is applied to the container, the post projecting from the central axis of the disk.

Bugla U.S. Pat. No. 3,432,065 and Hedgewick and Bauer U.S. Pat. No. 3,753,510 disclose closure assemblies wherein biasing and sealing members are secured to the end wall of a safety cap by interconnecting members formed on the spring member and the end wall of the respective safety caps.

Bauer U.S. Pat. No. 3,623,623 illustrates a safety package wherein a spring and sealing member is secured to the container, the spring member having an axial opening through which the contents of the container can be dispensed.

SUMMARY OF THE INVENTION

An object of the present invention is to provide a safety or child resistant closure and container assembly wherein a tight, moisture-proof seal is maintained when the closure is applied to a container by a unitary spring and sealing member held captive in the cap portion of the closure assembly by the cap bayonet lugs, so that the cap lugs pull the sealing portion out of engagement with the container when the cap is removed from the container so that the force required to remove the seating portion from the container is spread among the cap bayonet lugs.

A further object is to provide a safety closure and container assembly wherein a moisture-proof seal is maintained by the pressure of a spring member constructed so as to apply an axial force efficiently at the sealing member in such a manner as to press the sealing member tightly into engagement with the container.

In carrying out the foregoing, an other objects, a child resistant closure assembly according to the present invention includes a cap having an end wall with a skirt projecting therefrom with bayonet locking means formed on and projecting from the inner wall of the skirt for selective engagement with and disengagement from complementary bayonet locking means formed on the container by a combined axial and rotative motion of the cap relative to such container. A combined spring and sealing member is carried by the cap for biasing the cap bayonet locking means toward locked engagement with the container bayonet locking means, while at the same time maintaining a tight seal at the rim and mouth of the container to prevent the undesired escape of liquid contents from the container, or, alternatively, to minimize the entrance of moisture into the container.

The spring and sealing member are in the form of a one-piece molded plastic body having a sealing portion and a biasing portion, the sealing portion including a radially projecting annular sealing flange for overlying the rim of the container and an axially extending sealing flange for engaging the inner surface of the mouth portion of the container. The radially projecting annular sealing flange has an outer peripheral edge that overlies the bayonet locking means of the cap to retain the spring and sealing member captive between the end wall of the cap and the bayonet locking means of the cap, the spring and sealing member otherwise being unconnected with the cap.

The spring portion of the spring and sealing means is in the form of a dome-shaped member having a substantially flat cap engaging portion and a part spherical side wall portion, the periphery of the side wall portion being joined integrally to the inner periphery of the radially extending annular sealing portion that overlies the rim of the cap. The side wall of the dome-shaped spring member, when stressed upon applying the closure to the container, bows outwardly to produce both an axial and radial force on the sealing portion to press the annular sealing portion into tight engagement with the rim of the container and the axially extending sealing portion into tight engagement with the inner surface of the mouth of the container while at the same time biasing the bayonet locking means of the cap into locked engagement with the bayonet locking means of the container. When the closure assembly is removed from the container, the bayonet locking elements formed on the skirt of the cap cooperate to force the sealing member to separate from the container to permit access to the contents of the container.

Other objects, advantages and features of the invention will become apparent from the following description taken in connection with the accompanying drawings.

DESCRIPTION OF THE PREFERRED EMBODIMENT

Figure 1:
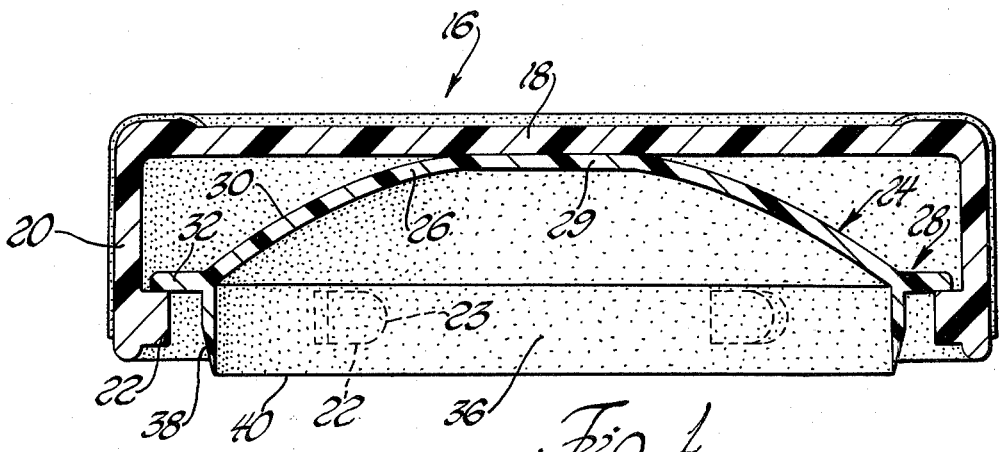
FIG. 1 is a sectional view of a safety closure assembly embodying the invention, the closure assembly being removed from the container.

With reference to the drawings, a safety closure and container assembly according to the illustrated embodiment includes a container designated generally by reference numeral 2 (FIG. 2) and having a neck or mouth portion 4 with an annular rim 6. Formed on the outer surface of the mouth portion 4 is a plurality of container locking elements 8, of the bayonet type, which are spaced peripherally from each other on the outer surface of the mouth portion. The container locking elements 8 may be spaced socket members projecting from the mouth portion 4 of the configuration disclosed in Hedgewick U.S. Pat. No. Re. 27,156 including a socket or notch 10 formed between a cam surface 14 and a depending stop portion 12.

The safety closure assembly for container 2 in the illustrated embodiment includes a cap 16 having an end wall 18 with a peripheral skirt 20 projecting axially therefrom for receiving the mouth portion 4 of the container 2. A plurality of cap locking elements 22, in the form of bayonet lugs, are spaced peripherally from each other and project inwardly from the inner surface of skirt 20. The cap locking elements 22 are in the form of radially inwardly projecting lugs integrally molded with the skirt 20, and are bayonet locking means in the sense that they cooperate, in bayonet fashion, with the container locking elements 8.

The cap locking elements 22 are complementary to the container locking elements 8 such that the locking elements or lugs 22 are engageable with the notches 20 in the container locking elements 8. The cap locking elements 22 are engageable with and disengageable from the container locking elements 8 by an axial motion followed successively by a rotative motion of the cap relative to the container. In order to apply the cap 16 to the container 2, the cap locking elements 22 are aligned with the spaces between the adjacent container locking elements 8 with the mouth portion 4 received in the skirt 20. Rotation of the cap relative to the container 2 causes the cap locking elements 22 to engage the respective cam surfaces 14 until the locking elements 22 come into axial alignment with the respective notches. In the illustrated embodiment, each lug 22 is of semicircular configuration at one end as indicated by reference numeral 23 to assist in providing a sliding engagement between the lugs 22 and the cam surface 14 of the container locking elements 8, as well as to reduce wear due to the elimination of sharp corners.

With the upper surfaces of the cap locking elements 22 engaged with the upper surfaces of the respective notches 10, the end wall 18 of cap 16 has a fixed axial position relative to rim 6 since the cap locking elements are located at equal axial distance from the wall 18 of skirt 20, and the container locking elements 8 are located an equal axial distance from rim 6. Cap 16 is biased against axial movement from locked engagement with the container, and a liquid-proof seal is maintained for the contents of the container, by a one-piece plastic spring and sealing member designated collectively by reference numeral 24.

Figure 2:
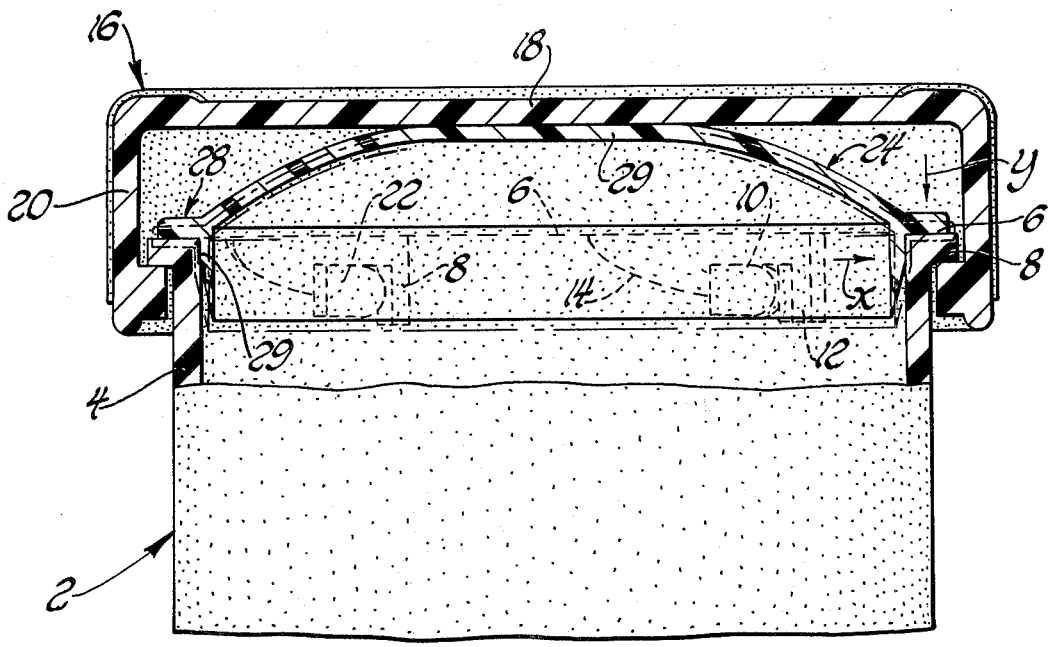
FIG. 2 is a sectional view of a safety closure and container assembly wherein the closure assembly of FIG. 1 is applied to a container.

The spring and sealing member 24 comprises a one-piece molded plastic body having an annular sealing portion designated generally by reference numeral 28 which, when the closure assembly is applied to the container as illustrated in FIG. 2, engages the rim 6 and the inner surface 29 of the mouth portion of the container. A dome-shaped spring member 26 is formed integrally with the sealing portion 28. The spring portion 26 has a flat cap engaging top wall portion 29 and a spherical side wall 30 having a peripheral edge portion which is joined integrally to the inner periphery of the sealing portion 28. The sealing portion 28 includes a radially extending annular sealing flange 32, the outer periphery of which overlies the cap locking elements 22 when the cap is removed from the container. The container locking elements 22 serve to hold the member 24 captive between the end wall 18 of the cap and the cap locking elements 22, the member 24 being otherwise unconnected with the cap 16. The sealing portion 28 further includes an axially extending sealing flange 36 having a tapered outer surface 38 to provide a relatively sharp peripheral edge portion 40 remote from the radially extending sealing flange 32. The lower peripheral edge of the spherical side wall 30 is joined integrally to the inner peripheral edge of the sealing flange 32. The upper peripheral edge of the spherical side wall 30 is joined integrally to the outer peripheral edge of the flap cap engaging portion 29.

The assembly of the cap 16 and sealing member 24 are shown disengaged from the container in FIG. 1. In the position of the member 24 as illustrated in FIG. 1, with the sealing flange 32 resting on the upper surfaces of the lugs 22, the cap engaging portion 29 only lightly engages, or possibly may be spaced slightly from the end wall 18 of the cap 16. However, as illustrated in FIG. 2, when the cap locking elements 22 are engaged with the container locking elements 8, the cap engaging portion 29 of the spring member 26 engages the end wall 18 of the cap causing the spherical side wall portion 30 to bow outwardly to resiliently apply both an axial and radially outward component of force to press the sealing portion 28 into tight sealing engagement with the inner surface 29 of the mouth of the container and against the rim 6.

The axial component of force, indicated by arrow Y in FIG. 2, forces the axially extending sealing flange 36 into the mouth of the container and forces the radially extending sealing flange 32 into tight sealing engagement with rim 6. The radially outwardly component of force, indicated by arrow X in FIG. 2, forces the sealing flange 36 into tight sealing engagement with the inner surface 29 of the mouth of the container.

The unstressed position of the sealing member 24 is indicated in phantom lines in FIG. 2 to illustrate the tight sealing engagement between the axially extending sealing flange 36 and the inner surface 29 of the mouth of the container, and between the radially extending sealing flange 32 and the rim 6, and that the spherical portion 30 of the spring member 26 is bowed outwardly by the axial compression thereof between the end wall 18 of the cap and rim 6.

When the closure assembly is removed from the cap, the spring member 26 is depressed to permit the lugs 22 to disengage from the notches of the container locking elements 8 whereupon the cap can be rotated to permit the lugs 22 to pass between the adjacent pairs of container locking elements 8 so that the closure assembly can be removed from the container. The lugs 22 then engage the flange 32 to force the sealing flanges 32 and 36 to separate from the container.

While a specific form of the invention has been illustrated in the accompanying drawings and described in the foregoing specification, it should be understood that the invention is not limited to the exact construction shown. To the contrary, alterations in the construction and arrangement of parts, all falling within the scope and spirit of the invention, will be apparent to those skilled in the art.

The embodiments of the present invention in which an exclusive property or privilege is claimed are defined as follows:

1. A safety closure assembly comprising: a cap having an end wall with a skirt projecting therefrom and a plurality of peripherally spaced bayonet locking elements formed on the inner surface of the skirt adapted to be engaged with and disengaged from complementary container bayonet locking elements on a container by combined axial and rotary motion of the cap relative to such container, and a spring and sealing member for sealingly engaging a container to which the cap is adapted to be applied and at the same time biasing the cap locking elements into locked engagement with the container locking elements, wherein the improvement comprises the spring and sealing member comprising a unitary plastic body having a sealing portion and a biasing portion, said sealing portion including a radially projecting, annular sealing flange for overlying the rim of the container and an axially extending sealing flange adapted to be received in the mouth of the container for sealing engagement with the inner surface thereof, said radially projecting, annular sealing flange overlying the cap locking elements to prevent axial separation of said spring and sealing member from said cap, said spring and sealing member being otherwise unconnected with said cap; said biasing portion being of domed configuration having a relatively flat cap engaging portion for engaging the end wall of the cap and a spherical side wall portion, said spherical side wall portion having an upper peripheral edge joined integrally to the outer periphery of said cap engaging portion and a lower peripheral edge joined integrally to the inner periphery of the radially projecting annular sealing flange such that the peripheral side wall bows outwardly when the cap is applied to a container due to compression of the side wall between the end wall of the cap and the radially projecting annular sealing flange caused by movement of the latter toward the end wall of the cap when the cap is applied to the container.

2. A safety closure and container assembly comprising:

a container having a mouth portion with an annular rim and a plurality of container locking elements spaced peripherally from each other on the outer surface of said mouth portion; a cap having an end wall with a skirt projecting therefrom for receiving said mouth portion, said cap having a plurality of cap locking elements formed integrally on the inner surface of said skirt; said cap locking elements being engageable with and disengageable from said container locking elements by an axial motion followed successively by a rotative motion of said cap relative to said container; a combined spring and sealing member carried by said cap, said combined spring and sealing member comprising a unitary plastic body having a sealing portion and a biasing portion; said sealing portion including a radially projecting, annular sealing flange overlying the rim of said container as well as the cap locking elements; said sealing portion further including an axially extending sealing flange projecting into the mouth of the container for sealing engagement with the inner surface of the mouth of the container; said biasing portion being of domed configuration having a lower peripheral edge joined integrally to said radially projecting annular sealing flange and a cap engaging portion for engaging the end wall of the cap such that when the cap locking elements are engaged with the container locking elements, the biasing portion is compressed between the rim of the container and the end wall of the cap to bias the cap toward locked engagement with the container; said radially projecting annular sealing flange engaging said cap locking elements when the cap is removed from the container such that the cap locking elements force the sealing portion to separate from the container and hold the combined spring and sealing member captive between the end wall of the cap and the cap locking elements, said combined spring and sealing member being otherwise unconnected with said cap.

* * * * *